US007487860B2

(12) United States Patent
Hikita et al.

(10) Patent No.: US 7,487,860 B2
(45) Date of Patent: Feb. 10, 2009

(54) CONTROLLER OF ONE-SHAFT MULTI-CAR SYSTEM ELEVATOR

(75) Inventors: Shiro Hikita, Tokyo (JP); Sakurako Tokura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 505 days.

(21) Appl. No.: 10/572,314

(22) PCT Filed: Aug. 31, 2004

(86) PCT No.: PCT/JP2004/012572

§ 371 (c)(1),
(2), (4) Date: Mar. 17, 2006

(87) PCT Pub. No.: WO2006/025103

PCT Pub. Date: Mar. 9, 2006

(65) Prior Publication Data

US 2007/0089935 A1 Apr. 26, 2007

(51) Int. Cl.
*B66B 9/00* (2006.01)

(52) U.S. Cl. ..... 187/249; 187/383; 187/384

(58) Field of Classification Search ..... 187/247, 187/249, 380–389, 902
See application file for complete search history.

(56) References Cited

U.S. PATENT DOCUMENTS 5,419,414 A * 5/1995 Sakita ..... 187/391
5,663,538 A * 9/1997 Sakita ..... 187/382
5,817,994 A * 10/1998 Fried et al. ..... 187/391
5,877,462 A * 3/1999 Chenais ..... 187/249
6,173,814 B1 * 1/2001 Herkel et al. ..... 187/288
6,223,861 B1 * 5/2001 Sansevero ..... 187/316
6,360,849 B1 * 3/2002 Hikita ..... 187/381
6,364,065 B1 * 4/2002 Hikita ..... 187/382
6,550,585 B2 * 4/2003 Schoppa et al. ..... 187/391
6,732,839 B2 * 5/2004 Schuster ..... 187/391
6,871,727 B2 * 3/2005 Jokela et al. ..... 187/383

FOREIGN PATENT DOCUMENTS

JP 06-305648 11/1994
JP 2000-226164 8/2000
JP 2003-160283 6/2003
JP 2003-206090 7/2003

* cited by examiner

*Primary Examiner*—Jonathan Salata
(74) *Attorney, Agent, or Firm*—Oblon, Spivak, McClelland, Maier & Neustadt, P.C.

(57) ABSTRACT

It is an object of the present invention to provide a control apparatus for a one-shaft multi-car system elevator in which a plurality of cars operate in one shaft, the control device being capable of efficient group control while avoiding collisions and minimizing the occurrence of confinement of passengers. The control apparatus includes approaching direction traveling prohibiting means 1D for prohibiting the cars from traveling in a direction in which the cars approach each other in the same shaft, and door open standing-by means 1E for causing the car to stand by with its doors open if the car is prohibited by the approaching direction traveling prohibiting means from traveling and if any passenger is present in the car.

3 Claims, 6 Drawing Sheets

CONTROLLER OF ONE-SHAFT MULTI-CAR SYSTEM ELEVATOR

TECHNICAL FIELD

The present invention relates to a control apparatus a one-shaft multi-car system elevator having a plurality of cars operate in one shaft.

BACKGROUND ART

If a plurality of elevators are installed together, group control is normally performed in order to efficiently operate these elevators. If group control is applied to a one-shaft multi-car system elevator in which a plurality of cars operate in one shaft, the elevator system must be controlled so that transportation efficiency is improved while avoiding the collision between the cars operating in the same shaft. This is the greatest difference from a normal elevator system in which one car operates in one shaft.

Proposed conventional techniques taking this into account include a multi-car system elevator system which performs cyclic operations capable of horizontal movement and in which a car entry prohibited section is set to perform control such that the car does not enter this section (see for example, Patent Document 1).

Another proposed conventional technique is a system which sets exclusive zones in which the respective cars are exclusively operated and a common zone and which provides means for retracting the car from the common zone to the exclusive zone and means for determining whether or not it is possible to advance from the exclusive zone into the common zone (see for example, Patent Document 2).

Patent Document 1: Japanese Patent No. 3029168

Patent Document 2: Japanese Patent Laid-Open No. 2003-160283

DISCLOSURE OF THE INVENTION

Problems to be Solved by the Invention

However, the former conventional technique does not disclose any means for improving transportation efficiency. Further, both conventional techniques describe means for avoiding collisions but neither of them refers to the confinement of passengers. The confinement of passengers refers to the following situation: if the car in which passengers are present is stopped for a safety reason, the passengers are confined, even though temporarily, in the car to wait for the car to restart. Such a situation need not be completely avoided as in the case of collisions. However, the confinement makes the passengers mentally uneasy. Thus, the occurrence of the confinement is desirably minimized.

The present invention is made to solve these problems. It is an object of the present invention to provide a control apparatus for a one-shaft multi-car system elevator in which a plurality of cars operate in one shaft, the control device being capable of efficient group control while avoiding collisions and minimizing the occurrence of confinement of passengers.

Means for Solving the Problems

The present invention provides a control apparatus for a one-shaft multi-car system elevator in which a plurality of cars operate in one shaft, the apparatus being characterized by comprising approaching direction traveling prohibiting means for prohibiting the cars from traveling in a direction in which the cars approach each other in the same shaft, and door open standing-by means for causing the car to stand by with its doors open if the car is prohibited by the approaching direction traveling prohibiting means from traveling and if any passenger is present in the car.

Also, the present invention provides a one-shaft multi-car system elevator in which two cars operate in one shaft, the apparatus being characterized by comprising zone setting means for setting a priority zone and a common zone for each of the upper and lower cars, retreating means for causing each car to retreat to a retreating floor as required when each car finishes service, approaching direction traveling prohibiting means for prohibiting the cars from traveling in a direction in which the cars approach each other in the same shaft, and door open standing-by means for causing the car to stand by at the retreating floor with its doors open if the car is prohibited by the approaching direction traveling prohibiting means from traveling and if any passenger is present in the car.

Moreover, the present invention provides a one-shaft multi-car system elevator in which two cars operate in one shaft, the apparatus being characterized by comprising zone setting means for setting a priority zone and a common zone for each of the upper and lower cars, retreating means for causing each car to retreat to a retreating floor as required when each car finishes service, approaching direction traveling prohibiting means for prohibiting the cars from traveling in a direction in which the cars approach each other in the same shaft, door open standing-by means for causing the car to stand by at the retreating floor with its doors open if the car is prohibited by the approaching direction traveling prohibiting means from traveling and if any passenger is present in the car, predictive evaluating means for predictively calculating and evaluating a wait time required for assignment of each car and a loss time resulting from the prohibition of traveling in the approaching direction when a hall call is generated, and assigning means for determining a final assigned car on the basis of the results of the calculations executed by the predictive evaluating means.

Advantages of the Invention

With the control apparatus for the one-shaft multi-car system elevator in accordance with the present invention, the cars are prohibited to travel in the direction in which the cars approach each other in the same shaft. Further, if the car is prohibited from traveling in the approaching direction and any passenger is present in the car, the car stands by with its doors open. This is effective in minimizing the time for which the passengers are confined to provide efficient control.

Further, the priority zone and common zone are set for each of the upper and lower cars so that when the car finishes service, it retreats to a retreating floor as required. Further, the cars are prohibited to travel in the direction in which the cars approach each other in the same shaft. If the car is prohibited from traveling in the approaching direction and any passenger is present in the car, the car stands by with its doors open. If a hall call is generated, the control apparatus predictively calculates and evaluates a wait time required if the car is assigned to the hall call and a loss time resulting from the prohibition of traveling in the approaching direction, to determine the final assigned car. Therefore, the present invention is effective in improving the transportation efficiency of the whole system while minimizing the time for which passengers are confined.

DESCRIPTION OF SYMBOLS

1 group control device
1A communication means
1B zone setting means
1C retreating means
1D approaching direction prohibiting means
1E door open standing-by means
1F predictive evaluating means
1G assigning means
1H operation control means
2 car control devices
3 floor buttons
4 hall lanterns
5 hall station

BEST MODE FOR CARRYING OUT THE INVENTION

For a detailed description, the present invention will be described with reference to the accompanying drawings.

EMBODIMENT 1

Figure 1:
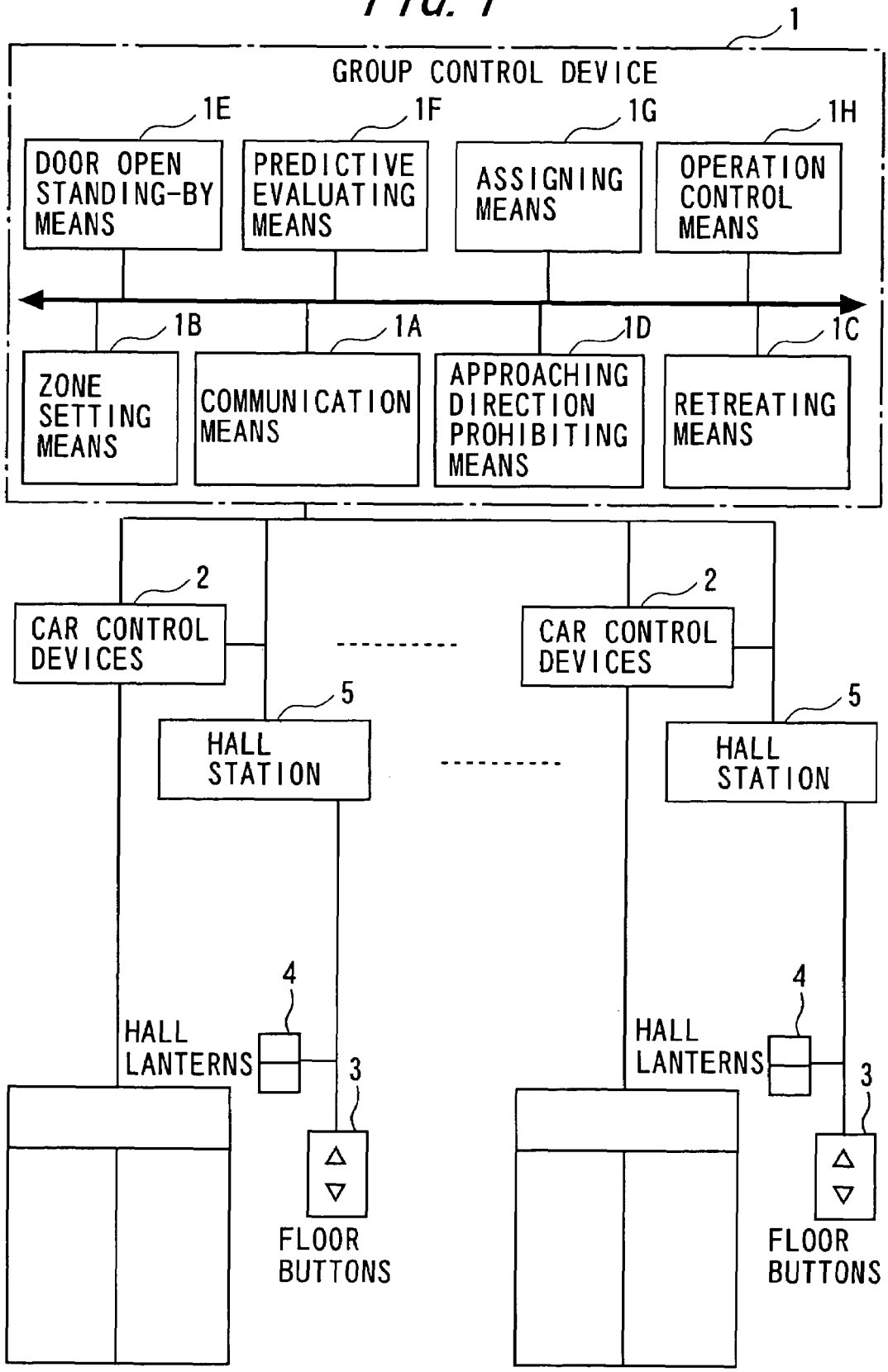
FIG. 1 is a block diagram showing an example of the general configuration of functions of a control apparatus for a one-shaft multi-car system elevator in accordance with Embodiment 1 of the present invention.

FIG. 1 is a block diagram showing an example of the general configuration of functions of a control apparatus for a one-shaft multi-car system elevator in accordance with Embodiment 1 of the present invention. The control apparatus for the one-shaft multi-car system elevator in accordance with the present invention is composed of a group control device 1 that efficiently performs group control on a plurality of cars (in this example, two cars: an upper and lower cars), car control devices 2 each of which controls the corresponding car, floor buttons 3 each of which is provided at the corresponding hall to register a hall call, hall lanterns 4 each of which is provided at the corresponding hall to display guidance for the arrival of each elevator and planned assignment for a hall call, and a hall station 5 that controls the hall equipment such as the hall buttons 3 and hall lanterns 4.

The group control device 1 includes communication means 1A, zone setting means 1B, retreating means 1C, approaching direction prohibiting means 1D, door open standing-by means 1E, predictive evaluating means 1F, assigning means 1G, operation control means 1H, and other means. The means 1A to 1H are composed of software on a microcomputer and function as described below.

The communication means 1A transmits information to and from each car control device 2 or the like. The zone setting means 1B sets a priority zone and a common zone for each of the upper and lower cars. The retreating means 1C causes the car to retreat to a retreating floor as required when the case finishes service. The approaching direction prohibiting means 1D prohibits the cars from traveling in the same shaft in a direction in which they approach each other. The door open standing-by means 1E causes the car to stand by at the retreating floor with its doors open if in accordance with an instruction from the approaching direction traveling prohibiting means 1D, the car is prohibited from traveling in the direction in which it approaches the other car and if passengers are present in the car. When a hall call is generated, the predictive evaluating means 1F predictively calculates and evaluates a loss time resulting from the stand-by time of the car and a wait time required for each call hall, and the like taking into account the prohibition of traveling in the approaching direction associated with the assignment of the cars. The assigning means 1G determines the final assigned car on the basis of the calculations executed by the predictive evaluating means 1F. The operation control means 1H generally controls the operation of each car on the basis of the assignments carried out by the assigning means 1G.

Now, with reference to FIGS. 2 to 8, description will be given of operations in accordance with Embodiment 1 of the present invention.

First, of the operations in accordance with Embodiment 1 of the present invention, the following operations will be described: setting of zones, a retreating operation associated with the setting, and an operation of prohibiting the cars from traveling in the approaching direction.

Figure 2:
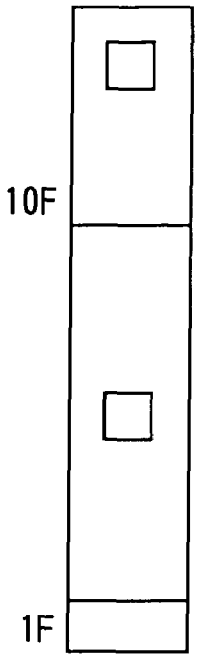
FIG. 2 is a diagram illustrating setting of zones in accordance with Embodiment 1 of the present invention.
Figure 3:
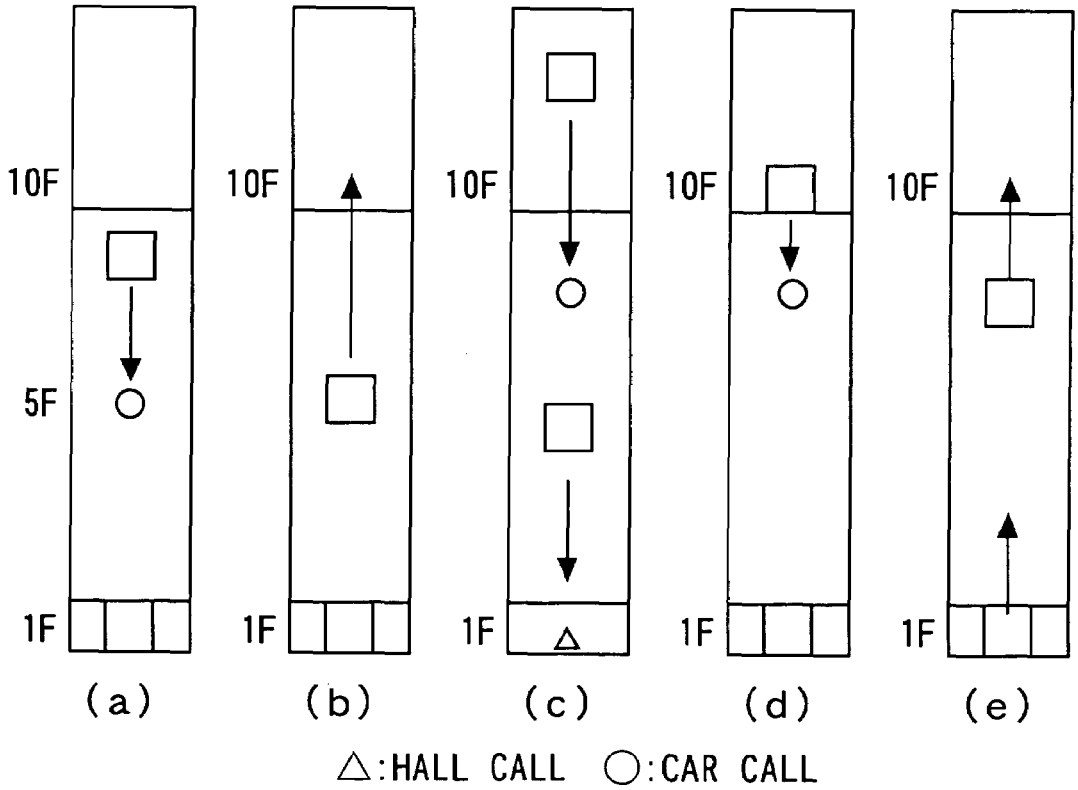
FIG. 3 is a diagram illustrating a retreating operation and an operation of prohibiting the cars from traveling in the approaching direction.
Figure 4:
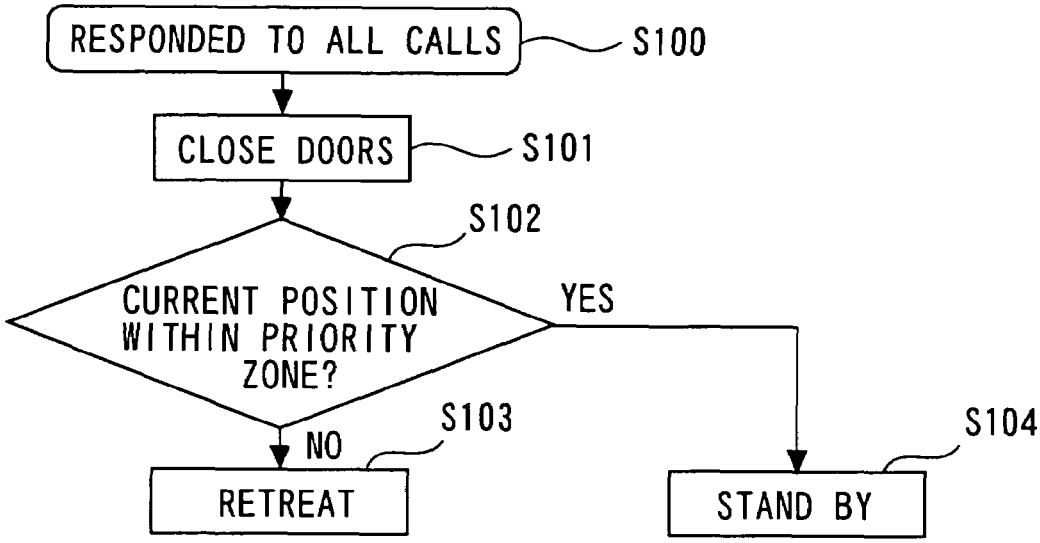
FIG. 4 is a flowchart schematically showing the retreating operation.
Figure 5:
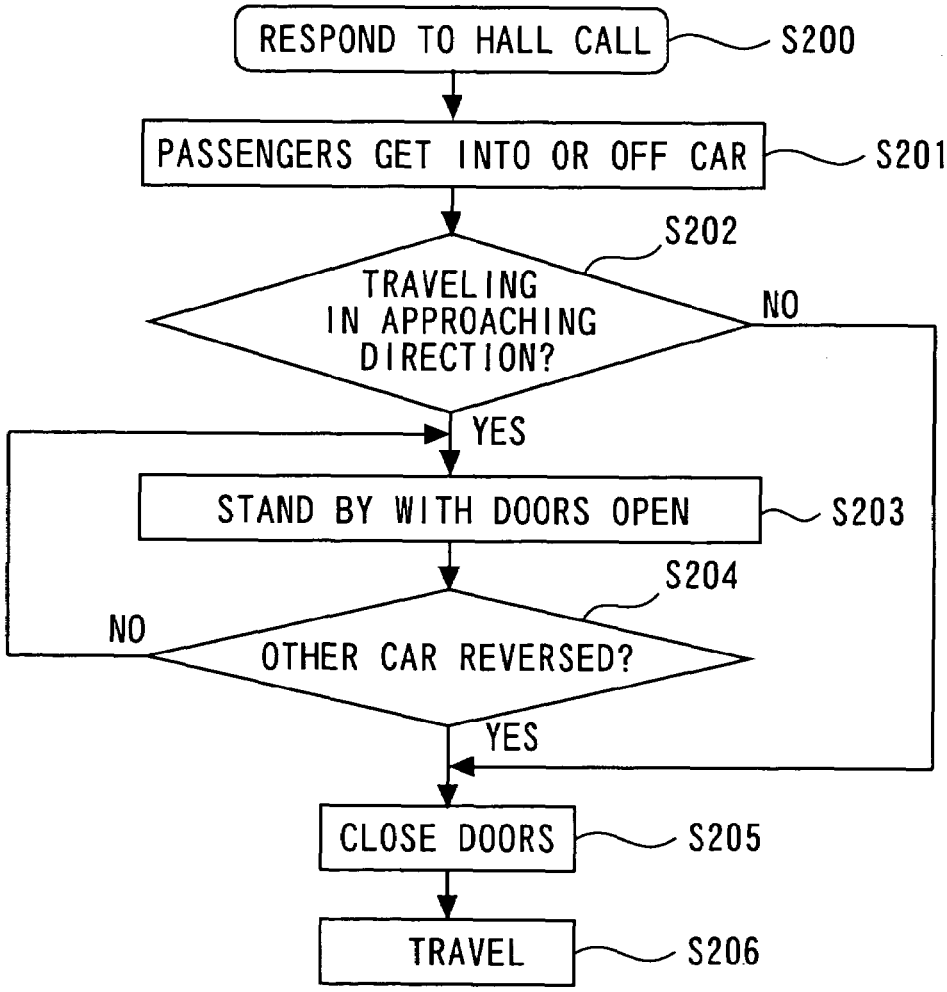
FIG. 5 is a flowchart schematically showing an approaching direction traveling prohibiting operation.

FIG. 2 is a diagram illustrating setting of zones in accordance with Embodiment 1 of the present invention. FIG. 3 is a diagram illustrating a retreating operation and an operation of prohibiting the cars from traveling in the approaching direction. FIG. 4 is a flowchart schematically showing the retreating operation. FIG. 5 is a flowchart schematically showing an approaching direction traveling prohibiting operation.

FIG. 2 shows an example of setting of a priority zone and a common zone. In FIG. 2, the tenth floor (10F) and the higher floors are set to be an upper car priority zone. The upper car responds to a hall call generated at any hall within the upper car priority zone. The lower car is not allowed to enter the upper car priority zone. Further, in FIG. 2, only the first floor (1F) is set to be a lower car priority zone. Only the lower car serves the first floor (1F). The second floor (2F) to ninth floor (9F) are designated as a common zone. Both the upper and lower cars serve each of the floors within the common zone. The preferred and common zones are desirably set for example, as follows.

(a) An entrance floor and the higher floors are designated as the lower car exclusive zone.

(b) The number of tenants in the building is accumulated from the uppermost floor, and the floors corresponding to half of the population are designated as the upper car exclusive zone.

(c) The remaining intermediate floors are designated as the common zone.

However, the above setting is only a standard or principle. The setting may be slightly shifted upward or downward for example, depending on the arrangement of tenants or the application of each floor. Alternatively, the zone setting may be varied so as to balance loads on the upper and lower cars depending on a variation in traffic during a day.

Further, such zone setting as shown in the example in FIG. 2 precludes passengers from being transported from the first floor to the tenth floor. In this case, the passengers may be guided to get into the car at the second floor. This may be easily accomplished by installing an information board or a display at the first floor or in some cases, installing an escalator between the first floor and the second floor. The division into service zones is also carried out in ordinary one-shaft one-car systems. Further, the guidance to the second floor is widely carried out in double deck systems. Such setting is carried out by the zone setting means 1B.

Now, with reference to FIG. 3, description will be given of the concept of a retreating operation and an operation of prohibiting the cars from traveling in the approaching direction in accordance with Embodiment 1 of the present invention. In each diagram in FIG. 3, the setting of the common and priority zones is the same as that in FIG. 2. In FIG. 3, <denotes a hall call, and 602 denotes a car call.

In FIG. 3(*a*), the lower car is standing by at the first floor (1F). The upper car has a car call from the fifth floor (SF) and is traveling downward. Subsequently, time elapses to bring the system into the state shown in FIG. 3(*b*). In FIG. 3(*b*), the upper car responds to the car call at the fifth floor (5F). Then, if the car call is final, then the car enters a standby state with its doors open if this system is of an ordinary one-shaft one-car system. However, in a one-shaft multi-car system, the subsequent operation of the lower car may be hindered by the upper car standing by at the fifth floor (SF) in the common zone. Accordingly, the upper car retreats to a predetermined floor within the upper car exclusive zone. This is the concept of the retreating operation in accordance with Embodiment 1 of the present invention.

In FIG. 3(*c*), the lower car is assigned to a hall call from the first floor (1F). The upper car has a car call from within the common zone. Both cars are thus traveling downward. Subsequently, time elapses to bring the system into the state shown in FIG. 3(*d*). In this case, the upper car is still traveling downward. The lower car has reached the first floor (1F) and passengers are getting into the car. Subsequently, once all the passengers get into the car, the car has its doors closed and then starts to travel upward if the system is of the ordinary one-shaft one-car type. However, in the one-shaft multi-car system, for a safety reason, the upper and lower cars are prohibited from traveling in the direction in which they approach each other. Accordingly, the lower car cannot leave until the upper car is reversed. Further, if the doors of the lower car are closed during such safety stand-by, the passengers are confined in the car to wait for the car to restart. Consequently, the passengers may feel oppressed. Thus, in the present invention, the lower car stands by with its doors open until the upper car is reversed.

Subsequently, the system enters the state shown in FIG. 3(*e*). When the upper car is reversed, the lower car has its door closed and then starts to travel upward. This is the concept of the operation of prohibiting the cars from traveling in the approaching direction in accordance with Embodiment 1 of the present invention.

Now, with reference to the flowchart in FIG. 4, description will be given of the retreating operation in accordance with Embodiment 1 of the present invention.

In step S100, the car completes responding to the final call and none of the passengers remains in the car. Then, in step S101, the doors of the car are closed. In step S102, the apparatus determines whether or not the current position is within the priority zone. If the current position is not within the priority zone, the process advances to step S103 to cause the car to retreat to a predetermined retreating floor within the priority zone. On the other hand, if the current position is within the priority zone, then in step S104, the car stands by with its doors closed. This operation is performed by the retreating means 1C.

A brief description has been given of the retreating operation in accordance with Embodiment 1 of the present invention.

Now, with reference to FIG. 5, description will be given of the approaching direction traveling prohibiting operation.

As shown in step S200, the car responds to a hall call. Then, in step S201, the doors of the car are opened and passengers get into the car. Then, in step S202, the apparatus determines whether or not the cars are to travel in the approaching direction. If the cars are to travel in the approaching direction, the process advances to step S203 to keep the car standing by with its doors open. Subsequently, in step S204, the car remains standing by with its doors open until the apparatus determines that the other car has been reversed.

If the apparatus does not determine in step S202 that the cars are to travel in the approaching direction or determines in step S204 that the other car has been reversed, the process advances to step S205 to close the doors of the car. The process then advances to step S206 to cause the car to start leaving and traveling.

This operation is preformed by the approaching direction prohibiting means 1D and door open standing-by means 1E.

A brief operation has been given of the approaching direction traveling prohibiting operation in accordance with Embodiment 1 of the present invention.

Figure 6:
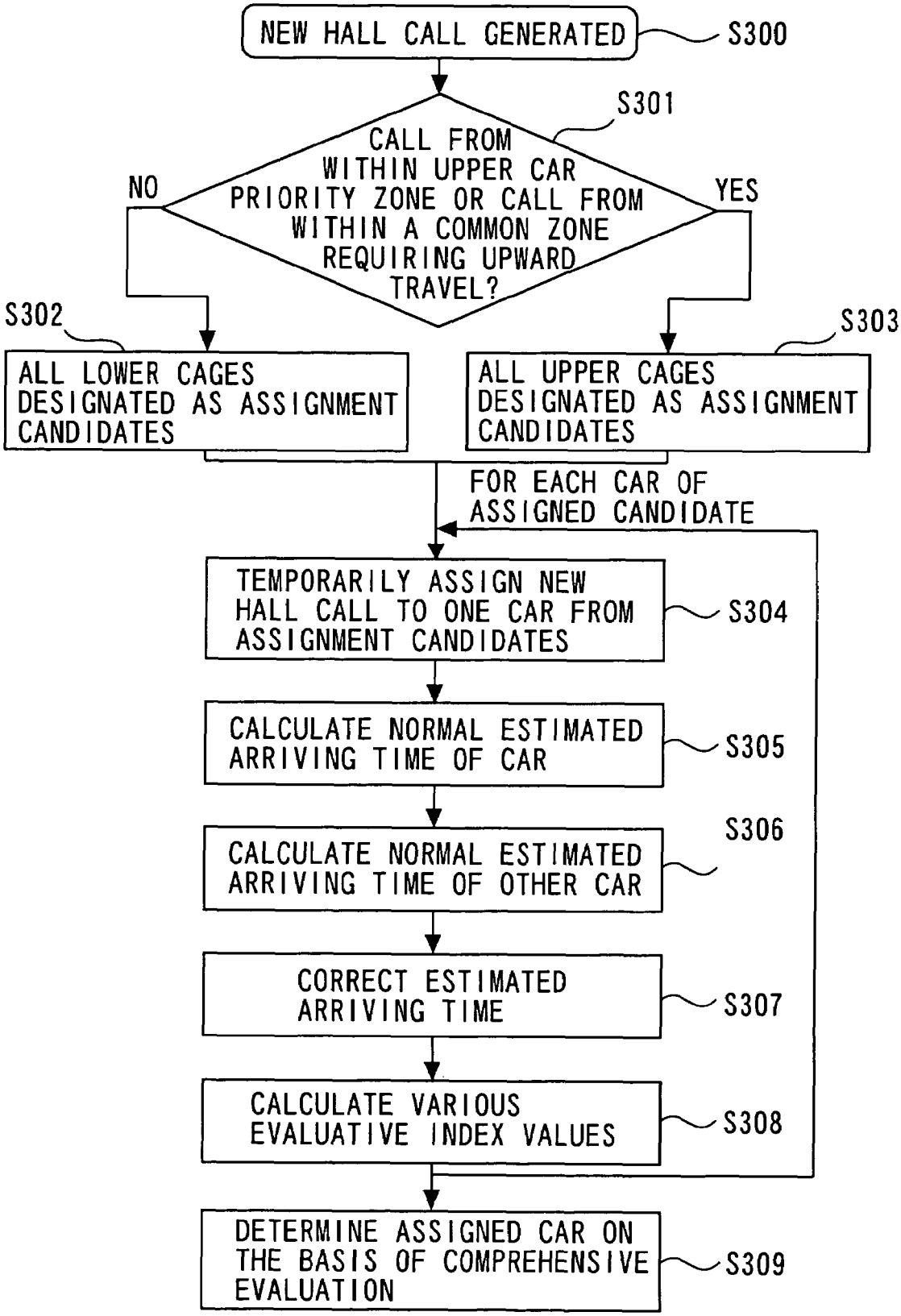
FIG. 6 is a flowchart schematically showing a procedure of determining an assigned car when a new hall call is generated in accordance with Embodiment 1 of the present invention.
Figure 7:
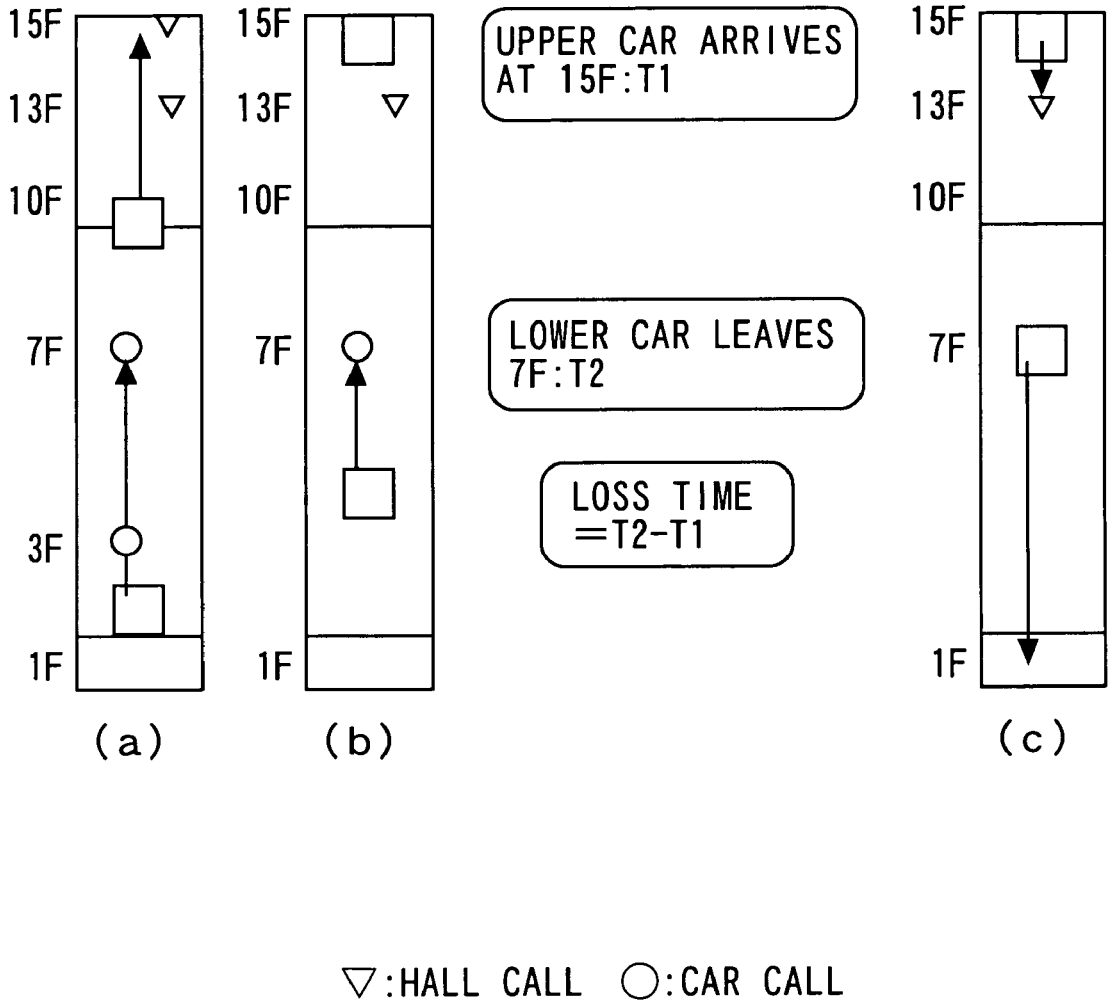
FIG. 7 is a diagram illustrating the calculation of a loss time resulting from the prohibition of traveling in the approaching direction and the corrective calculation of an estimated arriving time, the calculations being executed during the procedure of determining the assignment of the cars when a new hall call is generated in accordance with Embodiment 1 of the present invention.
Figure 8:
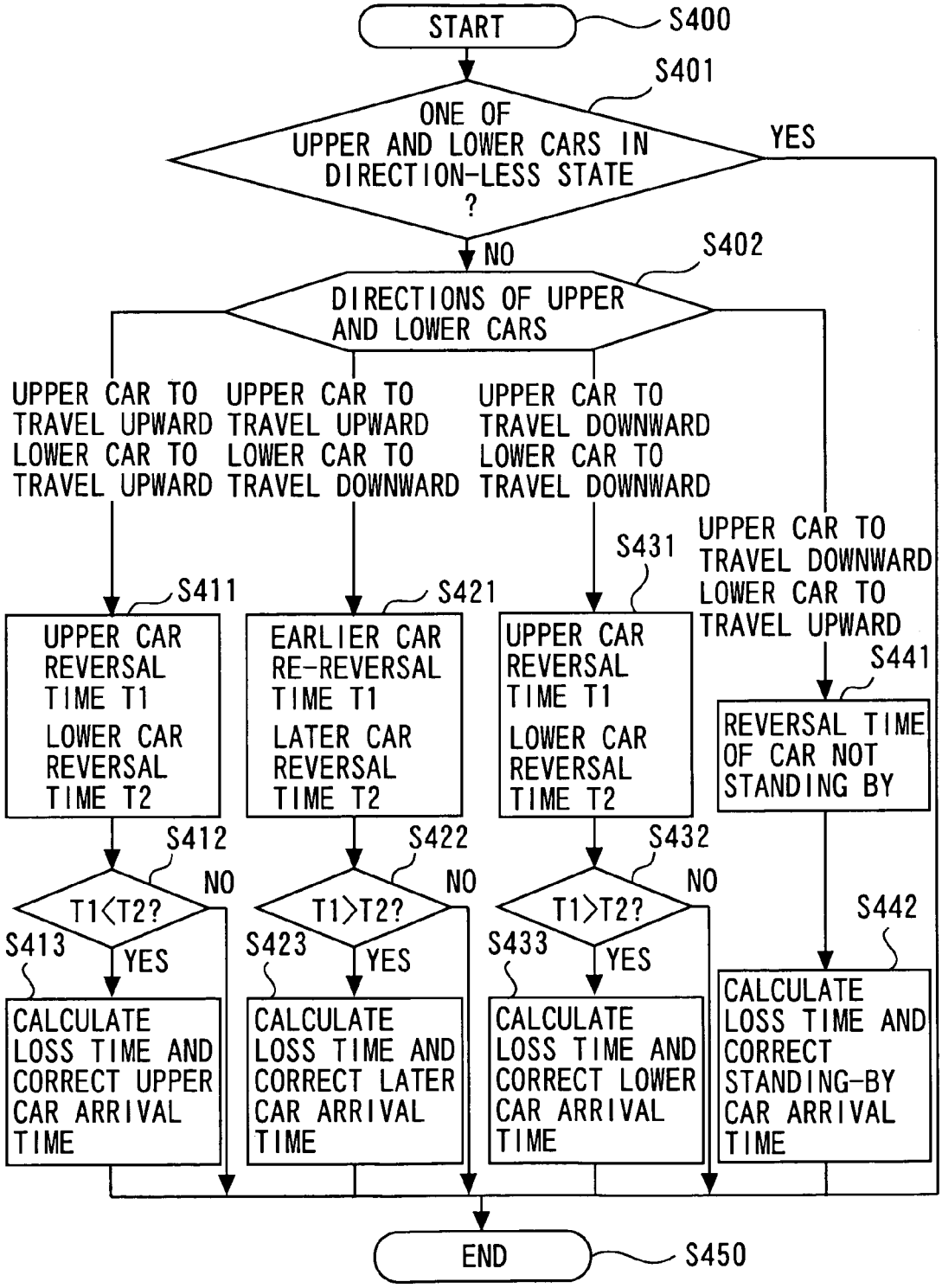
FIG. 8 is a flowchart schematically showing a procedure of calculating the loss time and correcting the estimated arriving time when a new hall call is generated in accordance with Embodiment 1 of the present invention.

Now, with reference to FIGS. 6, 7, and 8, description will be given of a procedure of determining the assignment of the cars when a new hall call is generated. FIG. 6 is a flowchart schematically showing a procedure of determining an assigned car when a new hall call is generated. FIG. 7 is a diagram illustrating the calculation of a loss time resulting from the prohibition of traveling in the approaching direction and the corrective calculation of an estimated arriving time, the calculations being executed during the procedure of determining the assignment of the cars when a new hall call is generated. FIG. 8 is a flowchart schematically showing a procedure of calculating the loss time and correcting the estimated arriving time when a new hall call is generated.

Here, the estimated arriving time is a predicted value for the time at which the car can arrive at a particular floor. The estimated arriving time is conventionally frequently used for group control.

In the example shown in FIG. 7, as shown in FIG. 7(*a*), the lower car has car calls from the third floor (3F) and seventh floor (7F) and is thus traveling upward. The upper car is assumed to be already assigned to a hall call from the 15-th floor (15F) which requires downward travel. In this case, a new hall call from the 13-th floor (13F) is assigned to the upper car.

In this case, the tenth and higher floors are designated as an upper car exclusive zone. The second to ninth floors are designated as a common zone.

Subsequently, if the upper car reaches the 15-th floor (15F) while the lower car is still traveling upward, as shown in FIG. 7(*b*), the upper car must remain at the 15-th floor and stand by with its doors open even after the passengers have gotten into the car, as previously described. It is not until the lower car is reversed and starts traveling downward as shown in FIG. 7(*c*) when the upper car can leave.

In this example, let T1 denote the time when all the passengers get into the upper car at the 15-th floor (15F). Further, let T2 denote the time when the lower car starts to travel downward from the seventh floor (7F) to enable the upper car to leave. Then, the passengers in the upper car are forced to wait for (T2−T1). This is a loss time resulting from the prohibition of traveling in the approaching direction.

FIG. 6 is a flowchart schematically showing a procedure of determining an assigned car for a new hall call taking the above loss time into account.

First, in step S300, a new hall call is generated. Then, in step S301, the apparatus determines in which zone the new hall call has been generated and whether the hall call requires upward or downward travel. Here, if the hall call has been generated in the priority zone, the lower car cannot provide service. The apparatus thus determines that the call should be assigned to the upper car. Moreover, even if the call has been generated within the common zone and requires upward travel, the apparatus determines that it should be assigned to the upper car. In this case, the process advances to step S303 to designate all the upper cars as candidates for a car assigned to the new hall call.

On the other hand, if the apparatus determines in step S301 that the call has been generated in the other zone, it then determines that the call should be assigned to the lower car. In step S302, all the lower cars are designated as candidates for a car assigned to the call.

Upon responding to a call from within the common zone which requires upward travel, the upper car travels automatically in a direction in which it leaves the common zone. In order to reduce the possibility of collisions and unwanted retreating travel, the present invention selects assignment candidates through the procedure in steps S301 to S303.

Once assignment candidates are selected through the procedure in steps S301 to S303, the procedure in steps S304 to S308 is executed on the cars included in the assignment candidates.

First, in step S304, one car included in the assignment candidates is extracted. The new hall call is temporarily assigned to this car. Then, with the hall call temporarily assigned to the car, the process advances to step S305 to calculate the time at which the car arrives at each floor, using a "normal procedure". The estimated arriving time is a predicted value for the time at which the car can arrive at a particular floor. This procedure is widely adopted for group control systems in the one-shaft one-car type. Further, the term "normal procedure" as used in the specification means that the estimated arriving time is calculated while neglecting the presence of the other car in the same shaft and without taking safety stop or an accompanying loss time into account.

After the estimated arriving time of the car is estimated in step S305, the estimated arriving time of the other car in the same shaft is similarly calculated in step S306.

Once the calculation of the estimated arriving time based on the "normal procedure" is finished on the upper and lower cars in the same shaft, the loss time is calculated and the estimated arriving times of the upper and lower cars in the same shaft are corrected in step S307. The procedure in step S307 will be detailed in further detail.

Then, in step S308, various evaluative index values are calculated for each assignment candidate car. The evaluative index values include the loss time, wait time evaluation, and riding time evaluation. Both the wait time evaluation and riding time evaluation can be calculated from the calculation of the estimated arriving time obtained as a result of the procedure ending in step S306. These evaluative index values are conventionally widely adopted for group control systems as in the operation procedure of the estimated arriving time. Thus, the detailed description of the procedure is omitted.

When the evaluations are calculated for each assignment candidate through the procedure ending in step S308, one of the assignment candidates is determined to be a final assigned car in step S309. There are various possible methods for determining the final assigned car. One of these methods makes determination by comprehensively evaluating various evaluative index values such as the wait time and loss time resulting from the assignment of the new hall call. For example, one of the methods uses the evaluative function shown below.

$J(e)=\min J(I)e$: assigned car, $I\chi$candidate car $J(I)=\Sigma w_i \times f_i(x)_i w_i$: weight, $x_i$: various evaluations such as the wait time By employing a weighted evaluative function as described above, it is possible to determine the assigned car taking into account the loss time, which is not conventionally considered. Further, even if the weight for the loss time is zeroed, since the estimated arriving time is corrected in step S307, the assignment can be carried out by taking into account the loss time and the adverse effect of the loss time on the wait time.

The predictive evaluating means 1F executes the procedure from steps S301 to S308. The assigning means 1G executes step S309.

A brief description has been given of the procedure of determining an assigned car for a new hall call in accordance with Embodiment 1 of the present invention.

Once the assigned car is determined, the operation control means 1H gives operation instructions such as an instruction on the assignment of the determined assigned car.

A brief description has been given of the procedure of determining an assigned car when a new hall call is generated in accordance with Embodiment 1 of the present invention.

Now, with reference to FIG. 8, a detailed description will be given of the procedure in step S307 in FIG. 6. FIG. 8 is a flowchart schematically showing a procedure of calculating the loss time and correcting the estimated arriving time when a new hall call is generated.

The procedure in step S307 is executed for each shaft. Accordingly, FIG. 8 shows a procedure for only one shaft.

First, a calculation is started in step S400 in FIG. 8. Then, in step S401, the apparatus determines whether or not one of the upper and lower cars in the shaft is in a direction-less state (standing by with its doors closed). If one of the cars is in the direction-less state, no loss time occurs. Consequently, the apparatus determines that the estimated arriving time need not be corrected. The process thus advances to step S450 to finish the procedure.

If neither of the cars is in the direction-less state, the process advances to step S402 to carry out classification depending on the directions of the upper and lower cars.

First, description will be given of the case in which both cars are to travel upward. In this case, the process advances to step S411. Then, with reference to the uncorrected estimated arriving time data determined in steps S305 and S306 in FIG. 6, the estimated reversal times (T1 for the upper car and T2 for the lower car) of the upper and lower cars are extracted.

In step S412, the apparatus determines whether the upper or lower car is reversed earlier. If the lower car is reversed earlier, the upper and lower cars are expected not to travel in the approaching direction. The process thus advances to step S450 to finish the procedure.

If the upper car is reversed earlier, the process advances to step S413. In this case, the upper car is expected to stand by at a standby floor for (T2−T1). Accordingly, this period is considered to be a loss time. Then, the estimated arriving time of the upper car is corrected by adding the value of (T2−T1) to the uncorrected estimated arriving times for the floors succeeding the reversing one.

Further, if the upper car is to travel upward, while the lower car is to travel downward, the process advances to step S421. Then, the estimated reversal times of the upper and lower cars are extracted. The later reversal time is defined as T2. Moreover, the time at which the earlier reversed car is re-reversed after traveling succeeding the reversal is defined as T1.

In step S422, the re-reversal time T1 of the earlier reversed car is compared with the reversal time T2 of the later reversed car to determine which re-reversal time is earlier. If the reversal time T2 of the later reversed car is later than the re-reversal time T1 of the earlier reversed car, the upper and lower cars are expected not to travel in the approaching direction. The process thus advances to step S450 to finish the procedure.

If the reversal time T2 of the later reversed car is earlier than the re-reversal time T1 of the earlier reversed car, the process advances to step S423. In this case, the later reversed car is expected to stand by at the reversing floor for (T1−T2). Accordingly, this period is considered to be a loss time. Then, the estimated arriving time of the later reversed car is corrected by adding the value of (T1−T2) to the uncorrected estimated arriving times for the floors succeeding the reversing one.

If both the upper and lower cars are to travel downward. The process advances to step S431. Also in this case, the estimated reversal times (T1 for the upper car and T2 for the lower car) of the upper and lower cars are extracted.

In step S432, the apparatus determines whether the upper or lower car is reversed earlier. If the upper car is reversed earlier, the upper and lower cars are expected not to travel in the approaching direction. The process thus advances to step S450 to finish the procedure.

If the lower car is reversed earlier, the process advances to step S433. In this case, the upper car is expected to stand by at the standby floor for (T1−T2). Accordingly, this period is considered to be a loss time. Then, the estimated arriving time of the lower car is corrected by adding the value of (T1−T2) to the uncorrected estimated arriving times for the floors succeeding the reversing one.

Further, if the upper car is to travel downward, while the lower car is to travel upward, since the cars are prohibited from traveling in the approaching direction as described above, one of the cars is standing by. Thus, in step S441, the reversal time T of the car not standing by is extracted. In step S442, the reversal time T is considered to be a loss time. Then, the estimated arriving time is corrected by adding the value of the reversal time T to the uncorrected estimated arriving times for the floors succeeding the current position of the standing-by car.

A brief description has been given of the procedure of calculating the loss time and correcting the estimated arriving time when a new hall call is generated. The procedure shown in the flowchart in FIG. 8 is executed for each shaft.

A brief description has been given of the operations in accordance with Embodiment 1 of the present invention.

INDUSTRIAL APPLICABILITY

As described above, the control apparatus for the one-shaft multi-car system elevator in accordance with the present invention can perform efficient group control while avoiding collisions and minimizing the occurrence of confinement of passengers.

The invention claimed is:

1. A control apparatus for a one-shaft multi-car system elevator in which a plurality of cars operate in one shaft, the apparatus being characterized by comprising approaching direction traveling prohibiting means for prohibiting the cars from traveling in a direction in which the cars approach each other in the same shaft, and door open standing-by means for causing the car to stand by with its doors open if the car is prohibited by the approaching direction traveling prohibiting means from traveling and if any passenger is present in the car.

2. A control apparatus for a one-shaft multi-car system elevator in which two cars operate in one shaft, the apparatus being characterized by comprising zone setting means for setting a priority zone and a common zone for each of the upper and lower cars, retreating means for causing each car to retreat to a retreating floor as required when each car finishes service, approaching direction traveling prohibiting means for prohibiting the cars from traveling in a direction in which the cars approach each other in the same shaft, and door open standing-by means for causing the car to stand by at the retreating floor with its doors open if the car is prohibited by the approaching direction traveling prohibiting means from traveling and if any passenger is present in the car.

3. A control apparatus for a one-shaft multi-car system elevator in which two cars operate in one shaft, the apparatus being characterized by comprising zone setting means for setting a priority zone and a common zone for each of the upper and lower cars, retreating means for causing each car to retreat to a retreating floor as required when each car finishes service, approaching direction traveling prohibiting means for prohibiting the cars from traveling in a direction in which the cars approach each other in the same shaft, door open standing-by means for causing the car to stand by at the retreating floor with its doors open if the car is prohibited by the approaching direction traveling prohibiting means from traveling and if any passenger is present in the car, predictive evaluating means for predictively calculating and evaluating a wait time required for assignment of each car and a loss time resulting from the prohibition of traveling in the approaching direction when a hall call is generated, and assigning means for determining a final assigned car on the basis of the results of the calculations executed by the predictive evaluating means.

* * * * *